US011131162B2

(12) United States Patent
Hern et al.

(10) Patent No.: US 11,131,162 B2
(45) **Date of Patent: *Sep. 28, 2021**

(54) FRAC PLUG SYSTEM WITH INTEGRATED SETTING TOOL

(71) Applicants: Gregory Hern, Porter, TX (US); YingQing Xu, Tomball, TX (US); Juan Carlos Flores Perez, The Woodlands, TX (US)

(72) Inventors: Gregory Hern, Porter, TX (US); YingQing Xu, Tomball, TX (US); Juan Carlos Flores Perez, The Woodlands, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/878,294

(22) Filed: May 19, 2020

(65) Prior Publication Data

US 2020/0277838 A1 Sep. 3, 2020

Related U.S. Application Data

(63) Continuation-in-part of application No. 16/195,282, filed on Nov. 19, 2018.

(51) Int. Cl.

| | |
|---|---|
| ***E21B 33/128*** | (2006.01) |
| ***E21B 23/04*** | (2006.01) |
| ***E21B 33/129*** | (2006.01) |

(52) U.S. Cl.

CPC ..... *E21B 33/128* (2013.01); *E21B 23/0412* (2020.05); *E21B 23/0417* (2020.05); *E21B 33/1293* (2013.01)

(58) Field of Classification Search

CPC ..... E21B 23/04; E21B 23/065; E21B 33/128; E21B 23/0417; E21B 23/0412; E21B 33/1293

See application file for complete search history.

(56) References Cited

U.S. PATENT DOCUMENTS 2,707,998 A 5/1955 Baker et al.
2,807,325 A * 9/1957 Webb ..... E21B 23/065 166/63

(Continued)

OTHER PUBLICATIONS

International Search Report and Written Opinion for Intnerional Application No. PCT/US2019/061806; International Filing Date Nov. 15, 2019; Report dated Mar. 11, 2020 (pp. 1-10).

(Continued)

*Primary Examiner* — Dany E Akakpo
(74) *Attorney, Agent, or Firm* — Cantor Colburn LLP

(57) ABSTRACT

A frac plug system, downhole tool and method of securing a frac plug system in a wellbore in a formation. A mandrel includes a first end and a second end. A setting assembly is coupled to the mandrel at the first end, and an anchor is arranged at the second end of the mandrel and receptive to the setting assembly. The anchor is settable to engage the wellbore. A bottom sub is arranged at the second end of the mandrel and includes a first member movable relative to the mandrel. A gas generates a pressure to shift the first member along the mandrel to move the anchor against the setting assembly, securing the setting assembly in the wellbore via radial deployment of the anchor. The mandrel is separated from the bottom sub to leave the setting assembly and the anchor in the wellbore.

20 Claims, 8 Drawing Sheets

(56) References Cited

U.S. PATENT DOCUMENTS

| | | | |
|---|---|---|---|
| 3,024,843 | A | 3/1962 | Dean |
| 3,977,473 | A | 8/1976 | Page |
| 5,024,270 | A | 6/1991 | Bostick |
| 7,017,672 | B2 | 3/2006 | Owen, Sr. et al. |
| 9,010,416 | B2 | 4/2015 | Ku et al. |
| 9,033,060 | B2 | 5/2015 | Ku et al. |
| 9,057,260 | B2 | 6/2015 | Kelbie et al. |
| 9,080,416 | B2 | 7/2015 | Ku et al. |
| 9,080,439 | B2 | 7/2015 | O'Malley et al. |
| 9,528,342 | B2 | 12/2016 | Xu et al. |
| 9,810,035 | B1 | 11/2017 | Carr et al. |
| 9,816,339 | B2 | 11/2017 | Xu |
| 9,976,381 | B2 | 5/2018 | Martin et al. |
| 10,443,331 | B1 | 10/2019 | Andres et al. |
| 2004/0216868 | A1 | 11/2004 | Owen, Sr. |
| 2005/0230100 | A1 | 10/2005 | Hirth et al. |
| 2010/0230116 | A1 | 9/2010 | Harmon et al. |
| 2013/0186649 | A1 | 7/2013 | Xu et al. |
| 2014/0041857 | A1 | 2/2014 | Xu et al. |
| 2014/0190685 | A1 | 7/2014 | Frazier et al. |
| 2015/0129203 | A1 | 5/2015 | Deutch et al. |
| 2016/0290093 | A1 | 10/2016 | Doane et al. |
| 2016/0312555 | A1 | 10/2016 | Xu et al. |
| 2017/0022781 | A1 | 1/2017 | Martin et al. |
| 2017/0130553 | A1* | 5/2017 | Harris ..... E21B 33/1208 |
| 2017/0234108 | A1 | 8/2017 | Xu |
| 2018/0016859 | A1 | 1/2018 | Stair et al. |
| 2018/0051532 | A1 | 2/2018 | Smith et al. |
| 2020/0157900 | A1 | 5/2020 | Hern et al. |
| 2020/0157913 | A1 | 5/2020 | Hern |
| 2020/0157915 | A1 | 5/2020 | Hern et al. |

OTHER PUBLICATIONS

International Search Report and Written Opinion for Intnerional Application No. PCT/US2019/061911; International Filing Date Nov. 18, 2019; Report dated Mar. 12, 2020 (pp. 1-11).

International Search Report and Written Opinion for Intnerional Application No. PCT/US2019/061914; International Filing Date Nov. 18, 2019; Report dated Mar. 16, 2020 (pp. 1-11).

* cited by examiner

FRAC PLUG SYSTEM WITH INTEGRATED SETTING TOOL

CROSS-REFERENCE TO RELATED APPLICATIONS

This application is a continuation-in-part of U.S. application Ser. No. 16/195,282, filed on Nov. 19, 2018, the contents of which are incorporated herein by reference in their entirety.

BACKGROUND

In the resource exploration and recovery industry, boreholes are formed to test for and recover formation fluids. During testing and extraction, various tools are deployed into the borehole. A frac plug may be set against a casing and used as part of a process that initiates a fracture in a formation. Setting a frac plug, or other seal may require the use of drop balls, explosive charges, or other tools that increase an overall cost and complexity of operation.

Typically, a force, which may be initiated by the explosive charge, may urge a setting member into a seal. After the frac plug is set, guns are fired to perforate the casing. Pressure may then be applied to a drop ball causing fluids to pass through perforations to create a fracture in the formation. Plugging and perforating the casing and fracturing the formation includes multiple steps. Accordingly, the art would be receptive of alternative methods for setting seals/plugs in a borehole.

SUMMARY

Disclosed is a method of securing a frac plug system in a wellbore in a formation, comprising: generating a pressure in a gas of the frac plug system disposed in the wellbore, the frac plug system including: a mandrel having a first end and a second end, a setting assembly is coupled to the mandrel at the first end, an anchor arranged at the second end of the mandrel and receptive to the setting assembly, the anchor settable to engage the wellbore, and a bottom sub arranged at the second end of the mandrel, the bottom sub including a first member movable relative to the mandrel, wherein generating the pressure in the gas shifts the first member along the mandrel to move the anchor against the setting assembly to secure the setting assembly in the wellbore via radial deployment of the anchor; and separating the mandrel from the bottom sub to leave the setting assembly and the anchor in the wellbore.

Also disclosed is a frac plug system, comprising: a mandrel having a first end and a second end, a setting assembly coupled to the mandrel at the first end, an anchor arranged at the second end of the mandrel and receptive to the setting assembly, the anchor settable to engage the wellbore, and a bottom sub arranged at the second end of the mandrel, the bottom sub including a first member movable relative to the mandrel to move the anchor against the setting assembly to secure the setting assembly in the wellbore via radial deployment of the anchor, wherein the mandrel is separable from the bottom sub to leave the setting assembly and the anchor in the wellbore.

Also disclosed is a downhole tool, comprising: a mandrel having a first end and a second end, a setting assembly coupled to the mandrel at the first end, an anchor arranged at the second end of the mandrel and receptive to the setting assembly, the anchor settable to engage the wellbore, and a bottom sub arranged at the second end of the mandrel, the bottom sub including a first member movable relative to the mandrel to move the anchor against the setting assembly to secure the setting assembly in the wellbore via radial deployment of the elastic anchor, wherein the mandrel is separable from the bottom sub to leave the setting assembly and anchor in the wellbore.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
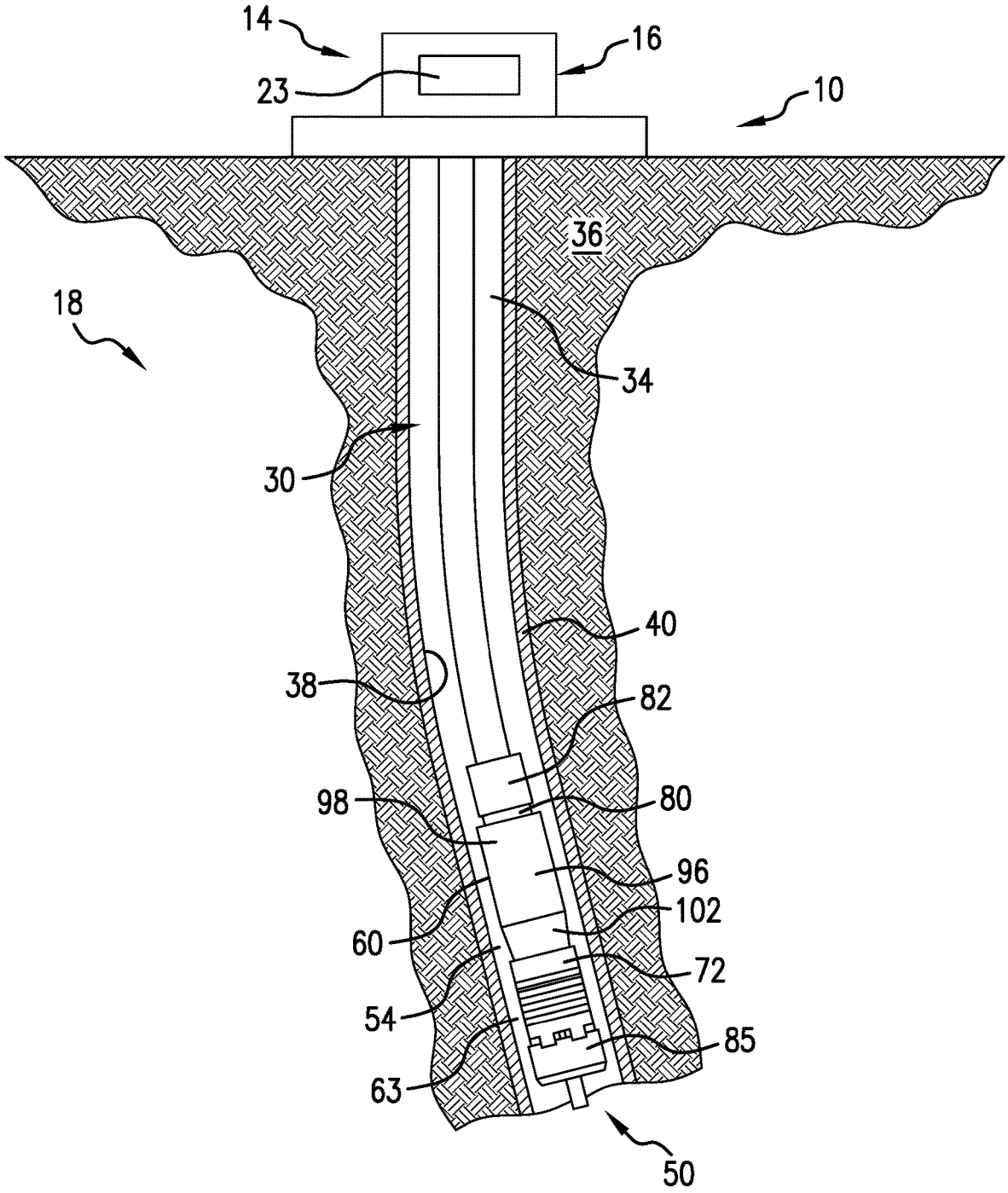
FIG. 1 depicts a resource exploration and recovery system including a frac plug system having an integrated setting tool, in accordance with an aspect of an exemplary embodiment.

A resource exploration and recovery system, in accordance with an exemplary embodiment, is indicated generally at 10, in FIG. 1. Resource exploration and recovery system 10 should be understood to include well drilling operations, completions, resource extraction and recovery, $CO_2$ sequestration, and the like. Resource exploration and recovery system 10 may include a first system 14 which, in some environments, may take the form of a surface system 16 operatively and fluidically connected to a second system 18 which, in some environments, may take the form of a subterranean system.

First system 14 may include a control system 23 that may provide power to, monitor, communicate with, and/or activate one or more downhole operations as will be discussed herein. Surface system 16 may include additional systems such as pumps, fluid storage systems, cranes and the like (not shown). Second system 18 may include a tubular string or wireline 30 that extends into a wellbore 34 formed in a formation 36. Wireline 30 may be operatively connected to control system 23. Wellbore 34 includes an annular wall 38 which may be defined by a surface of formation 36, or a casing tubular 40 such as shown.

Figure 2:
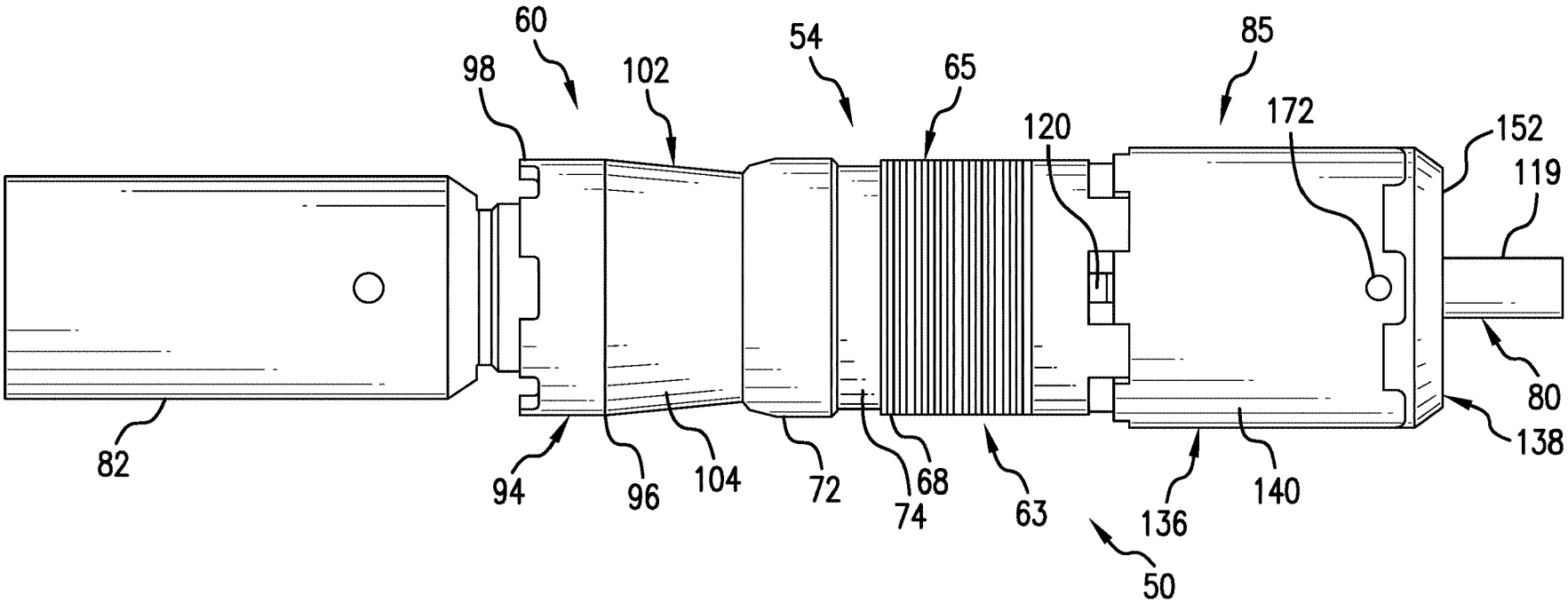
FIG. 2 depicts the frag plug system of FIG. 1, in accordance with an aspect of an exemplary embodiment.

In an exemplary aspect, wireline 30 supports a downhole tool 50. As will be detailed herein, downhole tool 50 may take the form of a frac plug system 54 that may be selectively engaged with annular wall 38. Referring to FIG. 2, and with continued reference to FIG. 1, frac plug system 54 includes a setting cone 60 that may force an anchor 63 into engagement with annular wall 38. Anchor 63 may take the form of a slip 65 having a plurality of wickers 68. Wickers 68 "bite" into annular wall 38 when slip 65 moves along setting cone 60. Anchor 63 includes a first end section 69 that receives setting cone 60 and a second end section 70. Setting cone 60 also supports a seal 72 and a backup ring 74. Backup ring 74 urges seal 72 along setting cone 60. Seal 72 may seal against annular wall 38.

A mandrel 80 extends through setting cone 60 and supports an actuator head 82. Mandrel 80 also extends through a bottom sub 85. As will be detailed herein, actuator head 82 establishes a force that drives anchor 63 along setting cone 60.

Figure 3:
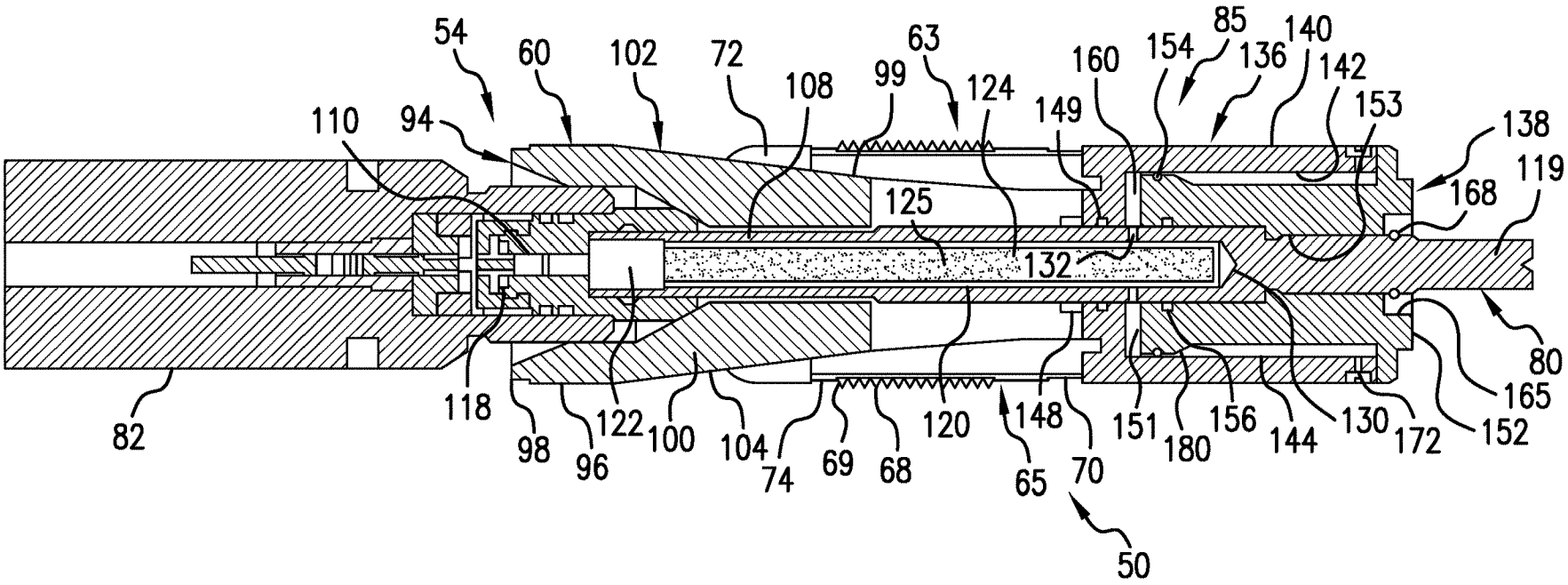
FIG. 3 depicts a cross-sectional view of the frac plug of FIG. 2, in accordance with an aspect of an exemplary embodiment.

Reference will now follow to FIG. 3, with continued reference to FIGS. 1 and 2 in further describing frac plug system 54. Setting cone 60 includes a body 94 having an outer surface 96 including a first end 98, a second end 99, and an intermediate portion 100. A portion of body 94 includes a taper 102. In an embodiment, taper 102 defines a frusto-conical surface 104 that extends from second end 99 toward first end 98. A passage 108 extends through body 94. Passage 108 includes an enlarged diameter portion (not separately labeled) that is receptive to a firing mechanism 110 of actuator head 82. Mandrel 80 extends through passage 108.

Mandrel 80 includes a first end portion 118, second end portion 119, and an intermediate section 120 extending therebetween. A conduit 122 extends through mandrel 80. A first portion (not separately labeled) of conduit 122 defines an activation chamber 124. Activation chamber 124 may take the form of a powder charge chamber (not separately labeled) housing power charge 125 that may take the form of an amount of propellant (also not separately labeled) which, when ignited, produces high pressure gases. Conduit 122 terminates at a blind end 130 within mandrel 80. A port 132 extends radially outwardly of conduit 122 through mandrel 80 at intermediate section 120.

In an embodiment, depicted in FIG. 3 bottom sub 85 includes a first member 136 and a second member 138. First member 136 includes an outer surface section 140 and an inner surface section 142 that defines an interior portion 144. First member 136 includes an opening 148 that is receptive of mandrel 80. A seal 149 is arranged in opening 148. Seal 149 seals against an outer surface (not separately labeled) of mandrel 80. Second member 138 includes a first end section 151 and a second end section 152. A shearable thread 153 attaches second member 138 to mandrel 80.

A first seal 154 extends about an exterior (not separately labeled) of second member 138 adjacent first end section 151. First seal 154 seals against inner surface section 142 of first member 136. A second seal 156 extends about an interior passage (not separately labeled) of second member 138. Second seal 156 seals against the outer surface of mandrel 80. A piston chamber 160 is formed between first end section 151 of second member 138 and an inner axial end wall (not separately labeled) of first member 136.

Second member 138 includes a recess 165 in second end section 152. A frangible element 168 is arranged about second end portion 119 of mandrel 80 in recess 165. Frangible element 168 prevents second member 138 from unthreading from mandrel 80 when pumping the downhole tool 50 into wellbore 34.

In an embodiment, frac plug system 54 is introduced into wellbore 34 and moved to a selected depth/position on, for example, wireline 30. Once in position, control system 23 may send a signal to actuator head 82 to activate firing mechanism 110 to set off the amount or propellant in activation chamber 124. Once ignited, the propellant or other substance produces a pressure wave that may travel down conduit 122 towards second end portion 119. The pressure wave passes through port 132 into piston chamber 160. The pressure wave causes slip 65 to break into segmented pieces (not separately labeled) allowing first member 136 to travel axially along mandrel 80 driving anchor 63 along setting cone 60.

Anchor 63 expands radially outwardly into contact with annular wall 38. In addition to setting anchor 63, first member 136 drives seal 72 and, in some embodiments, a backup ring (not shown) along setting cone 60. Seal 72 expands radially outwardly into contact with annular wall 38 forming a plug. Once the annular wall 38 of the casing prevents anchor 63 from expanding pressure applied in piston chamber 160 will increase until enough axial force is created to break shearable threads 153 and frangible element 168. Once set, downhole tool 50 may be withdrawn. At this point, bottom sub 85 may drop towards a toe (not shown) of wellbore 34. Mandrel 80 along with actuator head 82 may be withdrawn from wellbore 34. A plurality of fasteners, one of which is indicated at 172, keeps first member 136 from separating from second member 138 so that the plug will be easier to mill up.

In another embodiment, actuator head 82 may allow hydrostatic pressure to enter into activation chamber 124 and piston chamber 160 to apply a pressure differential against a chamber with atmospheric pressure in bottom sub (not shown) to shift first member 136 upward to set the frac plug system 54.

Figure 4:
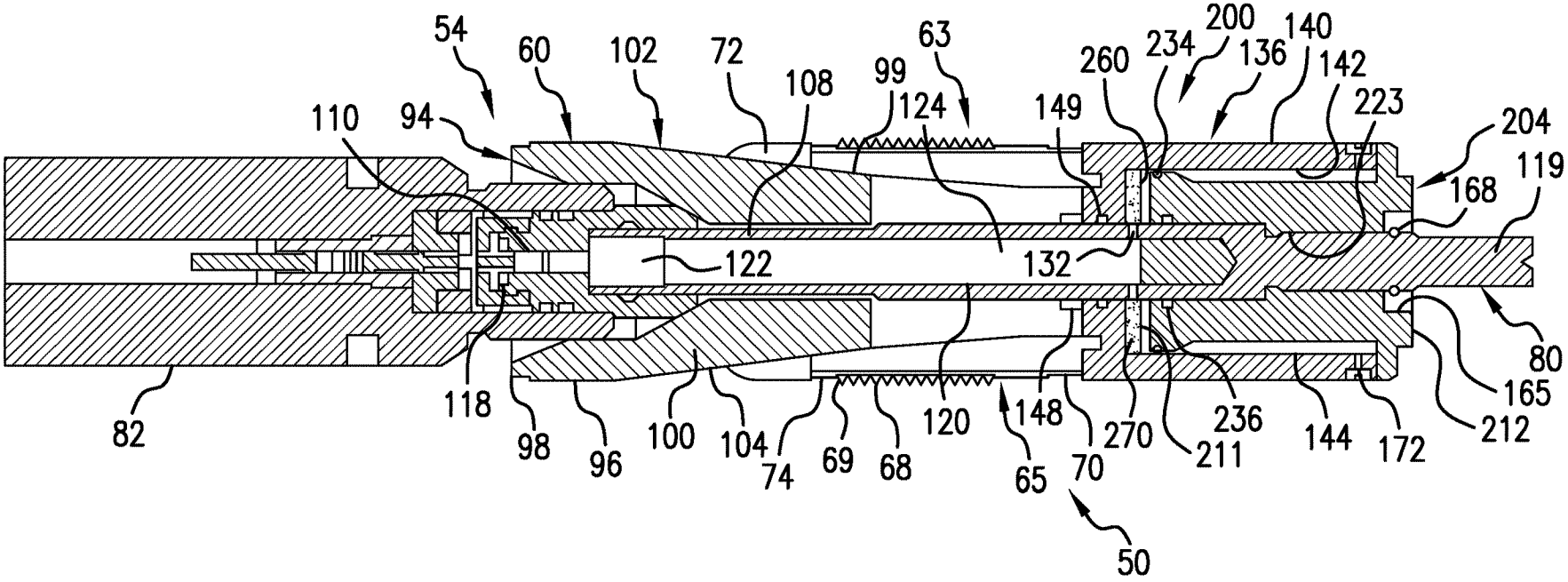
FIG. 4 depicts a cross-sectional view of the frac plug of FIG. 2, in accordance with another aspect of an exemplary embodiment.

Reference will now follow to FIG. 4, wherein like reference numbers present corresponding parts in the respective views, in describing a bottom sub assembly 200 in accordance with another aspect of an exemplary embodiment. Bottom sub assembly 200 includes first member 136 and a second member 204 having a first end section 211 and a second end section 212. A shearable thread 223 attaches second member 204 to mandrel 80. A first seal 234 extends about an exterior (not separately labeled) of second member 204 adjacent first end section 211. First seal 234 seals against inner surface section 142 of first member 136. A second seal 236 extends about an interior passage (not separately labeled) of second member 204. Second seal 236 seals against the outer surface of mandrel 80.

In an embodiment, a chamber 260 is formed between first end section 211 of second member 204 and an inner axial end wall (not separately labeled) of first member 136. In an embodiment, a power charge 270, which could take the form of an amount of propellant, is arranged in chamber 260. Power charge 270 may be operatively connected to firing mechanism 110 of actuator head 82 via activation chamber 124. In a manner similar to that discussed herein, control system 23 may send a signal to actuator head 82 to activate firing mechanism 110 to ignite power charge 270. Once ignited, power charge 270 produces or generates a pressure in a gas in the activation chamber 124 that causes slip 65 to break into segmented pieces allowing first member 136 to travel axially along mandrel 80 driving anchor 63 into along setting cone 60.

Anchor 63 expands radially outwardly into contact with annular wall 38. In addition to setting anchor 63, first member 136 drives seal 72, and, in some embodiments, a backup ring (not shown) along setting cone 60. Seal 72 expands radially outwardly into contact with annular wall 38 forming a plug. Once the annular wall 38 of the casing prevents anchor 63 from expanding pressure applied in chamber 260 will increase until enough axial force is created to break shearable threads 153 and frangible element 168. Once set, downhole tool 50 may be withdrawn. At this point, bottom sub 85 may drop towards a toe (not shown) of wellbore 34. Mandrel 80 along with actuator head 82 may be withdrawn from wellbore 34.

Figure 5:
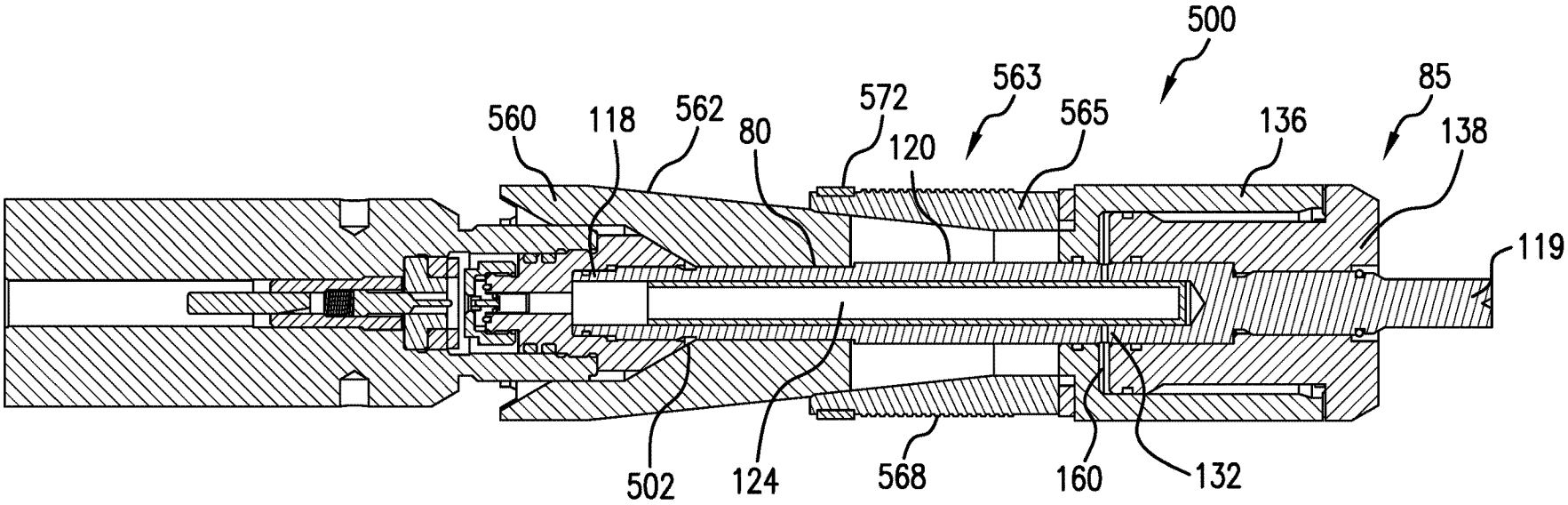
FIG. 5 shows a frac plug system in an alternate embodiment.

FIGS. 5-8 shows frac plug systems having alternative sleeve designs. FIG. 5 shows a frac plug system 500 in an alternate embodiment. The frac plug system 500 includes a mandrel 80 extending from a first end portion 118 to a second end portion 119 via an intermediate section 120 extending therebetween. A bottom sub is located at the second end portion 119 and includes a first member 136 and a second member 138. The second member 138 is fixedly attached to the mandrel 80 via frangible elements or threads as discussed with respect to FIGS. 3 and 4. The first member 136 is connected to the second member 138 via frangible elements. Once the frangible elements between the first member 136 and the second member 138 are ruptured or broken, the first member 136 is free to move axially with respect to the mandrel 80. When connected by the frangible elements, the first member 136 and the second member 138 form a piston chamber 160 that extends circumferentially around the mandrel 80. The mandrel 80 includes an activation chamber 124 having an explosive charge therein. An port 132 in the mandrel 80 provides fluid communication between the activation chamber 124 and piston chamber 160.

An anchor 563 is located on the intermediate section 120 and is mechanically coupled to the first member 136. The anchor 563 includes an expandable slip 565 or expandable sleeve that is made of an elastic material. The elastic slip 565 is capable of deforming or expanding radially to engage with the casing tubular 40 as a unitary piece, i.e, without breaking or rupturing, when a radial force is applied to it. The expandable slip 565 includes a rough outer surface 568 on its outer diameter for gripping the casing tubular 40. A seal 572 is supported by the expandable slip 565 and is disposed circumferentially around the expandable slip 565. A setting assembly having a setting cone 560 having a frusto-conical surface 562 is oriented along the mandrel to receive the expandable slip 565. The frusto-conical surface 562 tapers in the direction of the second end portion 119 or mandrel 80 or, in other words, reduces in diameter as one approaches the second end portion 119 from the first end portion 118.

The frac plug system 500 is secured in casing tubular 40 by igniting a charge to generate of increase a pressure in piston chamber 160 thereby moving the first member 136 of the bottom sub 85 toward the first end portion 118 of the mandrel 80. The expandable slip 565 moves against the setting cone 560, thereby expanding the expandable slip 565 radially outward. The seal 572 expands radially outward against the casing tubular 40 in order to form a seal between the expandable slip 565 and the casing tubular 40. The rough outer surface 568 of the expandable slip 565 grips the casing tubular 40. The anchor 563 and setting cone 560 are thus secured within the casing tubular 40. The mandrel 80 is then pulled uphole, leaving the anchor 563 and setting cone 560 downhole in the casing tubular. A plug or ball can then be dropped into the casing tubular 40 to land at a ball seat 502 of the setting cone 560. The setting cone 560 thus serves to set the frac plug system 500 in place and then afterward to provide a ball seat 502 for a plug.

Figure 6:
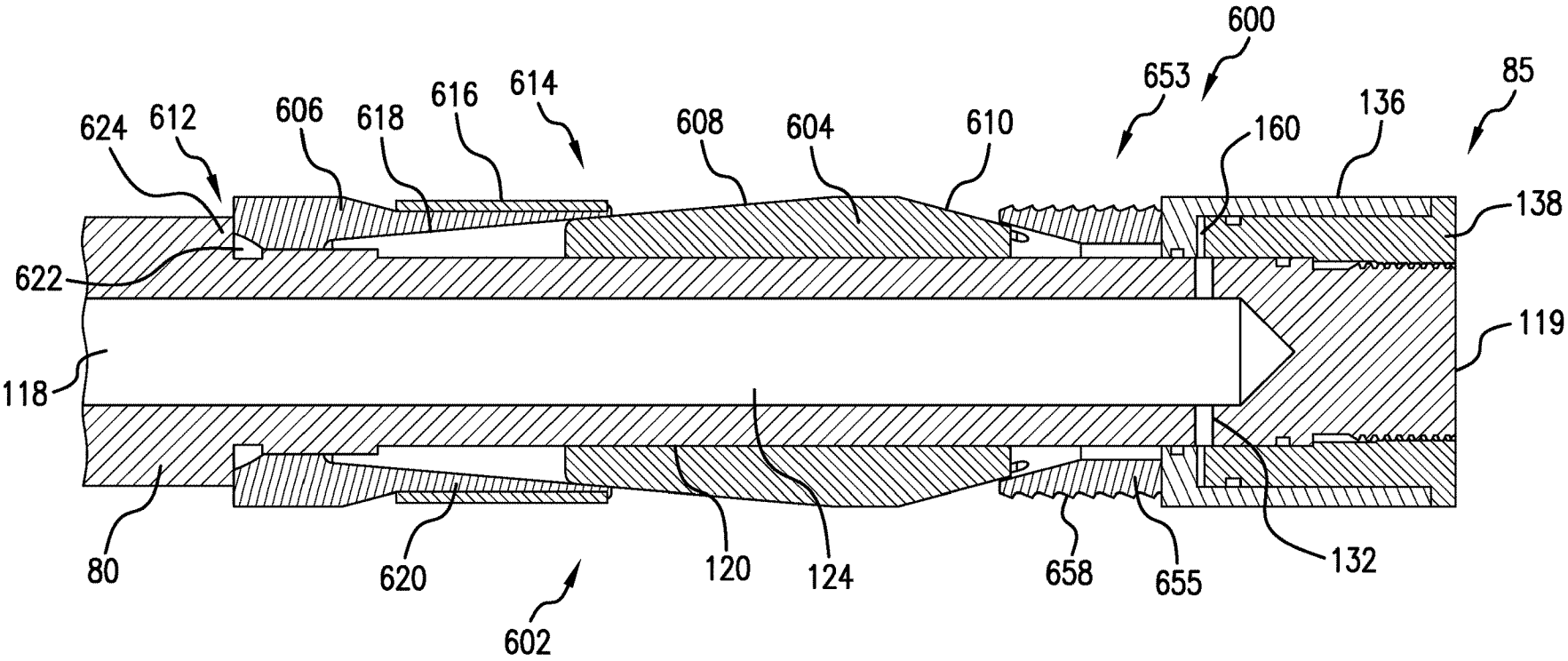
FIG. 6 shows a frac plug system in an alternate embodiment.

FIG. 6 shows a frac plug system 600 in an alternate embodiment. The frac plug system 600 includes a mandrel 80 extending from a first end portion 118 to a second end portion 119 and having intermediate section 120 therebetween. Bottom sub 85 is located at the second end portion 119, the bottom sub 85 including the first member 136 and the second member 138 which form a piston chamber 160 in fluid communication with activation chamber 124 of mandrel 80 via-port 132 in the mandrel 80.

Anchor 653 includes a slip 655 having a rough outer diameter surface 658. The slip 655 is expandable or breakable. An outer diameter surface of the slip includes a rough surface 658 for gripping a wall of the casing tubular. A setting assembly 602 is coupled to the mandrel 80 at the first end portion 118 of the mandrel 80. The setting assembly 602 includes a setting member 604 and a collar 606. The setting member 604 is disposed between the collar 606 and the anchor 653. The setting member 604 includes a first frusto-conical surface 608 that tapers in the direction of the collar 606 and a second frusto-conical surface 610 that tapers in the direction of the anchor 653. The collar 606 extends from a ball seat end 612 to a setting end 614 and includes a seal 616 on its outer diameter surface. A thin wall region 620 of the collar 606 is flexible in order to expand radially outward. An inwardly facing surface 618 of the thin wall region 620 tapers to form a funnel having an opening at the setting end 614. The slope of the surface 618 can be made to match the slope of the first frusto-conical surface 608 of the setting member 604. The setting end 614 thus receives the first frusto-conical surface 608 of the setting member 604.

When the charge is activated, the first member 136 moves toward the setting assembly 602. The slip 655 moves along the mandrel 80 and against the second frusto-conical surface 610, thereby moving the setting member 604 into the collar 606. The collar 606 is held in place with respect to the mandrel 80 via ridge 624 in the mandrel which serves as a mechanical stop for ball seat end 612. The first frusto-conical surface 608 therefore moves against the inwardly facing surface 618 of the collar 606 to expand the thin wall region 620 radially outward to press seal 616 against the casing tubular 40. Once the collar 606 is secured with the casing tubular 40 and the setting member 604 no longer moves with respect to the mandrel 80, the slip 655 moves against the second frusto-conical surface 610 of the setting member 604 to expand radially outward to secure anchor 653 in place within the casing tubular 40. The mandrel 80 can then be pulled uphole break or rupture frangible element between the second member 138 of the bottom sub 85 and the mandrel, thereby leaving the anchor 653, setting member 604 and collar 606 downhole. The collar 606 includes a ball seat 622 on its inner diameter surface for receiving a plug or ball that can be subsequently be dropped into the casing tubular 40.

Figure 7:
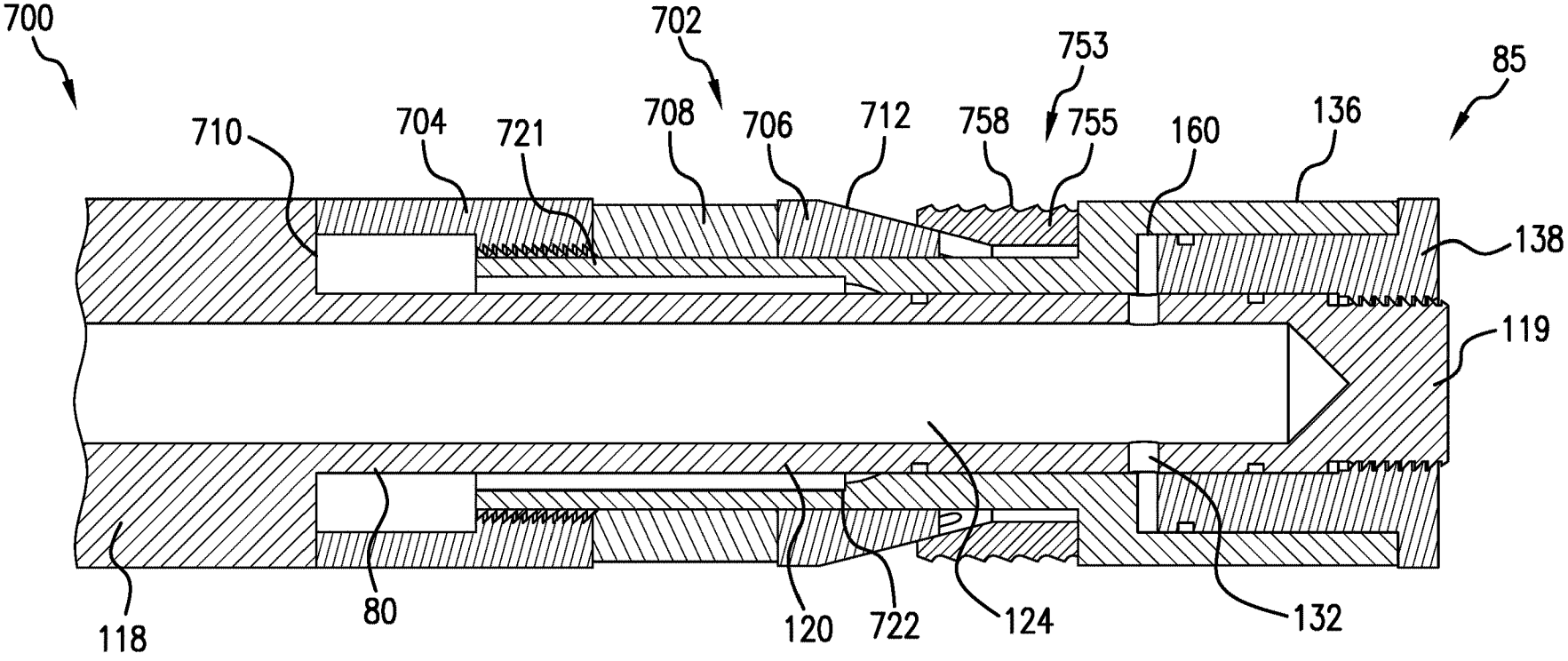
FIG. 7 shows the frac plug system in an alternate embodiment.

FIG. 7 shows the frac plug system 700 in an alternate embodiment. The frac plug system 700 includes a mandrel 80 extending from a first end portion 118 to a second end portion 119 and having intermediate section 120 therebetween. Bottom sub 85 is located at the second end portion 119, the bottom sub 85 including the first member 136 and the second member 138 which form a piston chamber 160 in fluid communication with activation chamber 124 of mandrel 80 via port 132 in the mandrel 80. The first member 136 includes a sleeve 721 that extends along the intermediate section 120 of the mandrel 80.

The frac plug system 700 further includes setting assembly 702 and an anchor 753. The anchor 753 includes a slip 755 having a rough outer diameter surface 758. The slip 755 can be expandable or breakable. The anchor 753 is coupled to the first member 136 of the bottom sub 85.

The setting assembly 702 is disposed along an outer diameter of the sleeve 721. The setting assembly 702 includes a first setting member 704, a second setting member 706 and an elastic seal member 708 located axially between the first setting member 704 and second setting member 706 and coupling the first setting member 704 to the second setting member 706. The first setting member 704 is prevented from moving toward the first end portion 118 by a ridge 710 in mandrel 80. The second setting member 706 includes a frusto-conical surface 712 that tapers in the direction of the anchor 753. Upon ignition of a charge, the first member 136 of the bottom sub 85 moves the anchor 753 against the frusto-conical surface 712 of the second setting member 706 to push the second setting member 706 in the direction of the first setting member 704. As the second setting member 706 moves toward the first setting member 704, the elastic seal member 708 is compressed and expands radially outward to form a seal against the casing tubular 40. Once the second setting member 706 is prevented from further axial motion, the expandable slip 755 of the anchor 753 moves against the frusto-conical surface 712 and expands radially outward in order to anchor the frac plug system 700 in the casing tubular 40.

The mandrel 80 is then pulled uphole, breaking away from the second member 138 of the bottom sub 85, and thereby leaving the anchor 753, first member 136 and setting assembly 702 downhole. The sleeve 721 of the first member 136 includes a ball seat 722 on its inner diameter surface for receiving a plug or ball that is subsequently dropped into the casing tubular 40.

Figure 8:
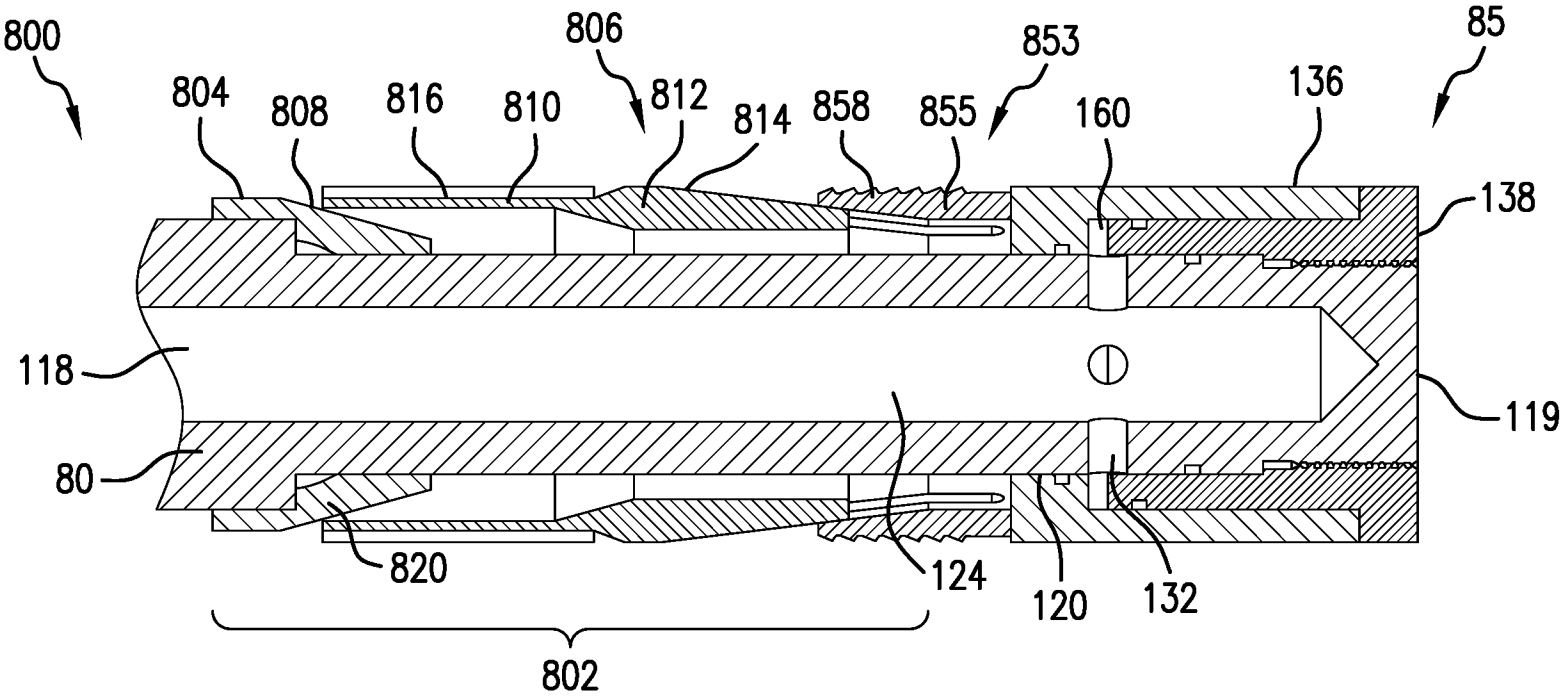
FIG. 8 shows a frac plug system in an alternate embodiment.

FIG. 8 shows a frac plug system 800 in an alternate embodiment. The frac plug system 800 includes a mandrel 80 extending from a first end portion 118 to a second end portion 119 and having intermediate section 120 therebetween. Bottom sub 85 is located at the second end portion 119, the bottom sub 85 including the first member 136 and the second member 138 which form a piston chamber 160 in fluid communication with activation chamber 124 of mandrel 80 via port 132 in the mandrel 80.

The frac plug system 800 further includes a setting assembly 802 and an anchor 853. The anchor 853 includes a slip 855 having a rough outer diameter surface 858. The slip 855 is expandable or breakable. The anchor 853 is coupled to the first member 136 of the bottom sub 85.

The setting assembly 802 includes a first setting cone 804 and a second setting cone 806 disposed between the first setting cone 804 and the anchor 653. The first setting cone 804 includes a frusto-conical surface 808 that tapers in the direction of the anchor 653. The second setting cone 806 includes a thin wall region 810 movable against the first setting cone 804 and a cone section 812 having a frusto-conical outer surface 814 that interacts with the anchor 853. The thin wall region 810 includes a seal 816 on its outer diameter surface.

Upon activation, the first member 136 of the bottom sub 85 moves axially against the second setting cone 806, thereby causing the second setting cone 806 to move against the first setting cone 804. The inner diameter surface of the thin wall region 810 moves along the frusto-conical surface 808 of the first setting cone 804, thereby expanding radially to press seal 816 against casing tubular 40. The anchor 653 then slides along the frusto-conical outer surface 814 of the second setting cone 806 to expand radially against the casing tubular 40 thereby securing the system in the casing.

The mandrel 80 is then pulled uphole, breaking away from the second member 138 of the bottom sub 85, and thereby leaving the anchor 853 and second setting cone 806 downhole. The first setting cone 804 includes a ball seat 820 on its inner diameter surface for receiving a plug or ball that can be subsequently dropped into the casing tubular 40.

Set forth below are some embodiments of the foregoing disclosure:

Embodiment 1

A method of securing a frac plug system in a wellbore in a formation. The method includes generating a pressure in a gas of the frac plug system disposed in the wellbore, the frac plug system including: a mandrel having a first end and a second end, a setting assembly is coupled to the mandrel at the first end, an anchor arranged at the second end of the mandrel and receptive to the setting assembly, the anchor settable to engage the wellbore, and a bottom sub arranged at the second end of the mandrel, the bottom sub including a first member movable relative to the mandrel, wherein generating the pressure in the gas shifts the first member along the mandrel to move the anchor against the setting assembly to secure the setting assembly in the wellbore via radial deployment of the anchor; and separating the mandrel from the bottom sub to leave the setting assembly and the anchor in the wellbore.

Embodiment 2

The method of any prior embodiment, wherein the bottom sub further includes a second member and the first member and the second member form a chamber receptive to a fluid in the mandrel.

Embodiment 3

The method of any prior embodiment, wherein the setting assembly further comprises a frusto-conical setting cone for receiving the anchor.

Embodiment 4

The method of any prior embodiment, wherein the anchor includes an expandable slip and expanding the anchor further comprises radially expanding the slip to engage the wellbore as a unitary piece.

Embodiment 5

The method of any prior embodiment, wherein the setting assembly further comprises a collar and a setting member having first frusto-conical surface receptive to the collar and a second frusto-conical surface receptive to the anchor.

Embodiment 6

The method of any prior embodiment, wherein the setting assembly further comprises first setting member, a second setting member having a frusto-conical surface for receiving the anchor and an elastic member that couples the first setting member to the second setting member, wherein moving the second setting member by the anchor expands the elastic member into sealing arrangement with the wellbore.

Embodiment 7

The method of any prior embodiment, wherein the setting assembly further comprises first setting cone and a second setting cone, wherein the second setting cone moves against the first setting cone to set the second setting cone in the wellbore, the first setting cone being coupled to the mandrel.

Embodiment 8

A frac plug system. The system includes a mandrel having a first end and a second end, a setting assembly coupled to the mandrel at the first end, an anchor arranged at the second end of the mandrel and receptive to the setting assembly, the anchor settable to engage the wellbore, and a bottom sub arranged at the second end of the mandrel, the bottom sub including a first member movable relative to the mandrel to move the anchor against the setting assembly to secure the setting assembly in the wellbore via radial deployment of the anchor, wherein the mandrel is separable from the bottom sub to leave the setting assembly and the anchor in the wellbore.

Embodiment 9

The frac plug system of any prior embodiment, wherein the bottom sub further includes a second member and the first member and the second member form a chamber receptive to a fluid in the mandrel.

Embodiment 10

The frac plug system of any prior embodiment, wherein the setting assembly further comprises a frusto-conical setting cone for receiving the anchor.

Embodiment 11

The frac plug system of any prior embodiment, wherein the anchor includes an expandable slip and expanding the anchor further comprises radially expanding the slip to engage the wellbore as a unitary piece.

Embodiment 12

The frac plug system of any prior embodiment, wherein the setting assembly further comprises a collar and a setting member having first frusto-conical surface receptive to the collar and a second frusto-conical surface receptive to the anchor.

Embodiment 13

The frac plug system of any prior embodiment, wherein the setting assembly further comprises first setting member, a second setting member having a frusto-conical surface and an elastic member that couples the first setting member to the second setting member.

Embodiment 14

The frac plug system of any prior embodiment, wherein the setting assembly further comprises a first setting cone and a second setting cone, wherein the second setting cone moves against the first setting cone to set the second setting cone in a wellbore, the first setting cone being coupled to the mandrel.

Embodiment 15

A downhole tool. The downhole tool includes a mandrel having a first end and a second end, a setting assembly coupled to the mandrel at the first end, an anchor arranged at the second end of the mandrel and receptive to the setting assembly, the anchor settable to engage the wellbore, and a bottom sub arranged at the second end of the mandrel, the bottom sub including a first member movable relative to the mandrel to move the anchor against the setting assembly to secure the setting assembly in the wellbore via radial deployment of the elastic anchor, wherein the mandrel is separable from the bottom sub to leave the setting assembly and anchor in the wellbore.

Embodiment 16

The downhole tool of any prior embodiment, wherein the bottom sub further includes a second member and the first member and the second member form a chamber receptive to a fluid in the mandrel.

Embodiment 17

The downhole tool of any prior embodiment, wherein the anchor includes an expandable slip and expanding the anchor further comprises radially expanding the slip as a unitary piece.

Embodiment 18

The downhole tool of any prior embodiment, wherein the setting assembly further comprises a collar and a setting member having first frusto-conical surface receptive to the collar and a second frusto-conical surface receptive to the anchor.

Embodiment 19

The downhole tool of any prior embodiment, wherein the setting assembly further comprises first setting member, a second setting member having a frusto-conical surface and an elastic member that couples the first setting member to the second setting member.

Embodiment 20

The downhole tool of any prior embodiment, wherein the setting assembly further comprises a first setting cone and a second setting cone, wherein the second setting cone moves against the first setting cone to set the second setting cone in a wellbore, the first setting cone being coupled to the mandrel.

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizingZ, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A method of securing a frac plug system in a wellbore in a formation, comprising:

generating a pressure in a gas of the frac plug system disposed in the wellbore, the frac plug system including:

a mandrel having a first end and a second end;

a setting assembly is coupled to the mandrel at the first end;

an anchor arranged at the second end of the mandrel and receptive to the setting assembly, the anchor settable to engage the wellbore; and a bottom sub arranged at the second end of the mandrel, the bottom sub including a first member movable relative to the mandrel;

wherein generating the pressure in the gas shifts the first member along the mandrel to move the anchor against the setting assembly to secure the setting assembly in the wellbore via radial deployment of the anchor; and separating the mandrel from the bottom sub to leave the setting assembly and the anchor in the wellbore.

2. The method of claim 1, wherein the bottom sub further includes a second member and the first member and the second member form a chamber receptive to a fluid in the mandrel.

3. The method of claim 1, wherein the setting assembly further comprises a frusto-conical setting cone for receiving the anchor.

4. The method of claim 1, wherein the anchor includes an expandable slip and expanding the anchor further comprises radially expanding the slip to engage the wellbore as a unitary piece.

5. The method of claim 1, wherein the setting assembly further comprises a collar and a setting member having first frusto-conical surface receptive to the collar and a second frusto-conical surface receptive to the anchor.

6. The method of claim 1, wherein the setting assembly further comprises first setting member, a second setting member having a frusto-conical surface for receiving the anchor and an elastic member that couples the first setting member to the second setting member, wherein moving the second setting member by the anchor expands the elastic member into sealing arrangement with the wellbore.

7. The method of claim 1, wherein the setting assembly further comprises first setting cone and a second setting cone, wherein the second setting cone moves against the first setting cone to set the second setting cone in the wellbore, the first setting cone being coupled to the mandrel.

8. A frac plug system, comprising:

a mandrel having a first end and a second end;

a setting assembly coupled to the mandrel at the first end;

an anchor arranged at the second end of the mandrel and receptive to the setting assembly, the anchor settable to engage a wellbore; and a bottom sub arranged at the second end of the mandrel, the bottom sub including a first member movable relative to the mandrel to move the anchor against the setting assembly to secure the setting assembly in the wellbore via radial deployment of the anchor;

wherein the mandrel is separable from the bottom sub to leave the setting assembly and the anchor in the wellbore.

9. The frac plug system of claim 8, wherein the bottom sub further includes a second member and the first member and the second member form a chamber receptive to a fluid in the mandrel.

10. The frac plug system of claim 8, wherein the setting assembly further comprises a frusto-conical setting cone for receiving the anchor.

11. The frac plug system of claim 8, wherein the anchor includes an expandable slip and expanding the anchor further comprises radially expanding the slip to engage the wellbore as a unitary piece.

12. The frac plug system of claim 8, wherein the setting assembly further comprises a collar and a setting member having first frusto-conical surface receptive to the collar and a second frusto-conical surface receptive to the anchor.

13. The frac plug system of claim 8, wherein the setting assembly further comprises first setting member, a second setting member having a frusto-conical surface and an elastic member that couples the first setting member to the second setting member.

14. The frac plug system of claim 8, wherein the setting assembly further comprises a first setting cone and a second setting cone, wherein the second setting cone moves against the first setting cone to set the second setting cone in wellbore, the first setting cone being coupled to the mandrel.

15. A downhole tool, comprising:

a mandrel having a first end and a second end;

a setting assembly coupled to the mandrel at the first end;

an anchor arranged at the second end of the mandrel and receptive to the setting assembly, the anchor settable to engage a wellbore; and a bottom sub arranged at the second end of the mandrel, the bottom sub including a first member movable relative to the mandrel to move the anchor against the setting assembly to secure the setting assembly in the wellbore via radial deployment of the anchor;

wherein the mandrel is separable from the bottom sub to leave the setting assembly and anchor in the wellbore.

16. The downhole tool of claim 15, wherein the bottom sub further includes a second member and the first member and the second member form a chamber receptive to a fluid in the mandrel.

17. The downhole tool of claim 15, wherein the anchor includes an expandable slip and expanding the anchor further comprises radially expanding the slip as a unitary piece.

18. The downhole tool of claim 15, wherein the setting assembly further comprises a collar and a setting member having first frusto-conical surface receptive to the collar and a second frusto-conical surface receptive to the anchor.

19. The downhole tool of claim 15, wherein the setting assembly further comprises first setting member, a second setting member having a frusto-conical surface and an elastic member that couples the first setting member to the second setting member.

20. The downhole tool of claim 15, wherein the setting assembly further comprises a first setting cone and a second setting cone, wherein the second setting cone moves against the first setting cone to set the second setting cone in the wellbore, the first setting cone being coupled to the mandrel.

* * * * *